US006019112A

United States Patent [19]

Matlock

[11] Patent Number: 6,019,112

[45] Date of Patent: Feb. 1, 2000

[54] HOME GREENHOUSE KIT

[76] Inventor: Cameron Arthur Matlock, RR 1, Granded Prairie Alberta, Canada, T8V 2Z8

[21] Appl. No.: 09/034,990

[22] Filed: Mar. 5, 1998

[51] Int. Cl.[7] ..... E04H 15/00

[52] U.S. Cl. ..... 135/124; 135/125; 135/127; 135/137

[58] Field of Search ..... 47/17; 52/63, 80.1, 52/86, DIG. 17; 135/87, 116, 119, 121, 123–125, 127, 137

[56] References Cited

U.S. PATENT DOCUMENTS

| | | | |
|---|---|---|---|
| 4,815,736 | 3/1989 | Wright | 135/102 |
| 5,335,684 | 8/1994 | Hanninen | 135/102 |
| 5,562,115 | 10/1996 | Sotelo | 135/156 |

*Primary Examiner*—Beth A. Aubrey

[57] ABSTRACT

A home greenhouse kit including a semi-circular housing member that has an upper portion. The upper portion is formed by two layers of flexible sheeting and a plurality of elongated parallel rib channels formed between the two layers. A pair of ground panels of the semi-circular housing member is interconnected to the upper portion. A plurality inflatable tubes are sized for positioning within the plurality of elongated rib channels for giving the upper portion of the semi-circular housing member vertical integrity. A plurality of interior grommets are positioned about an arc of the upper portion. A pair of support poles forming a front support pole and a rear support pole are provided. Each support pole has a top end with an eyelet. Lastly, an elongated support rope is extended through the plurality of interior grommets. The support rope has a front portion extended through the eyelet of the front support pole and a rear portion extended through the eyelet of the rear support pole.

7 Claims, 2 Drawing Sheets

HOME GREENHOUSE KIT

BACKGROUND OF THE INVENTION

1. Field of the Invention

The present invention relates to a home greenhouse kit and more particularly pertains to providing an portable greenhouse for gardening at home.

2. Description of the Prior Art

The use of a portable greenhouse is known in the prior art. More specifically, portable greenhouses heretofore devised and utilized for the purpose of growing plants are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,831,793 to Galloway discloses a greenhouse. U.S. Pat. No. 5,335,684 to Hanninen discloses a covered frame shelter and method of erection. U.S. Pat. No. 4,091,584 to Brown discloses a small building structure. U.S. Pat. No. 3,961,442 to Carter discloses a portable greenhouse. U.S. Pat. No. 3,892,094 to Spray discloses a shelter having a stressed frame with a flexible sheeting thereon. Lastly, U.S. Pat. Des. No. 299,753 to Virgilio discloses a greenhouse.

In this respect, the home greenhouse kit according to the present invention substantially departs from the conventional concepts and designs of the prior art, and in so doing provides an apparatus primarily developed for the purpose of providing an portable greenhouse for gardening at home.

Therefore, it can be appreciated that there exists a continuing need for a new and improved home greenhouse kit which can be used for providing an portable greenhouse for gardening at home. In this regard, the present invention substantially fulfills this need.

SUMMARY OF THE INVENTION

In view of the foregoing disadvantages inherent in the known types of portable greenhouses now present in the prior art, the present invention provides an improved home greenhouse kit. As such, the general purpose of the present invention, which will be described subsequently in greater detail, is to provide a new and improved home greenhouse kit which has all the advantages of the prior art and none of the disadvantages.

To attain this, the present invention essentially comprises a semi-circular housing member. The housing member has an upper portion. The upper portion is formed by two layers of flexible sheeting and a plurality of elongated parallel rib channels formed between the two layers. The plurality of elongated parallel rib channels are proportionately spaced one from another. A plurality of inflatable tubes are sized for positioning within the plurality of elongated rib channels. The plurality of inflatable tubes give the upper portion of the semi-circular housing member vertical integrity. The upper portion has an interior wall, an exterior wall, a front wall and a rear wall. The interior wall has a plurality of interior grommets positioned about an arc of the upper portion. One of each of the plurality of grommets is juxtapose one of the plurality of rib channels.

Also, a pair of ground panels are included. The pair of ground panels of the semi-circular housing member are interconnected to the upper portion. The pair of ground panels are formed by two layers of flexible sheeting. The pair of ground panels extending outwardly from symmetrical sides of the exterior wall of the upper portion. Each of the pair of ground panels have a plurality of exterior grommets spaced from an end edge. Additionally, the front wall of the upper portion of the semi-circular housing member has a door flap and a screen portion. The door flap and screen portion allow entry and exit of the semi-circular housing member.

Included are a pair of support poles. The support poles form a front support pole and a rear support pole. Each support pole has a top end and a bottom end. The bottom end of each pole has a diameter greater than a diameter of the top end. Each top end has an eyelet. Finally, an elongated support rope is extended through the plurality of interior grommets. The support rope, when positioned through the interior grommets, has a front portion extending from the front wall of the upper portion and a rear portion extending from the rear wall of the upper portion. The front portion of the support rope is threaded through the eyelet of the front support pole for securement to the ground. The rear portion of the support rope is threaded through the eyelet of the rear support pole for securement to the ground. The support rope is threaded through the interior grommets and secured to the ground for ensuring that the integrity of the upper portion is maintained from tensions caused by the securement of the support rope.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved home greenhouse kit which has all the advantages of the prior art portable greenhouses and none of the disadvantages.

It is another object of the present invention to provide a new and improved home greenhouse kit which may be easily and efficiently manufactured and marketed.

It is a further object of the present invention to provide a new and improved home greenhouse kit which is of a durable and reliable construction.

An even further object of the present invention is to provide a new and improved home greenhouse kit which is susceptible of a low cost of manufacture with regard to both materials and labor, and which accordingly is then susceptible of low prices of sale to the consuming public, thereby making such Home greenhouse kit economically available to the buying public.

Still yet another object of the present invention is to provide a new and improved home greenhouse kit which provides in the apparatuses and methods of the prior art some of the advantages thereof, while simultaneously overcoming some of the disadvantages normally associated therewith.

Still another object of the present invention is to providing an portable greenhouse for gardening at home.

Lastly, it is an object of the present invention to provide a new and improved semi-circular housing member that has an upper portion and a floor portion. The upper portion is formed by two layers of flexible sheeting and a plurality of elongated parallel rib channels formed between the two layers. The floor portion of the semi-circular housing member is interconnected to the upper portion. A plurality inflatable tubes are sized for positioning within the plurality of elongated rib channels for giving the upper portion of the semi-circular housing member vertical integrity. A plurality of interior grommets are positioned about an arc of the upper portion. A pair of support poles forming a front support pole and a rear support pole are provided. Each support pole has a top end with an eyelet. Lastly, an elongated support rope is extended through the plurality of interior grommets. The support rope has a front portion extended through the eyelet of the front support pole and a rear portion extended through the eyelet of the rear support pole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
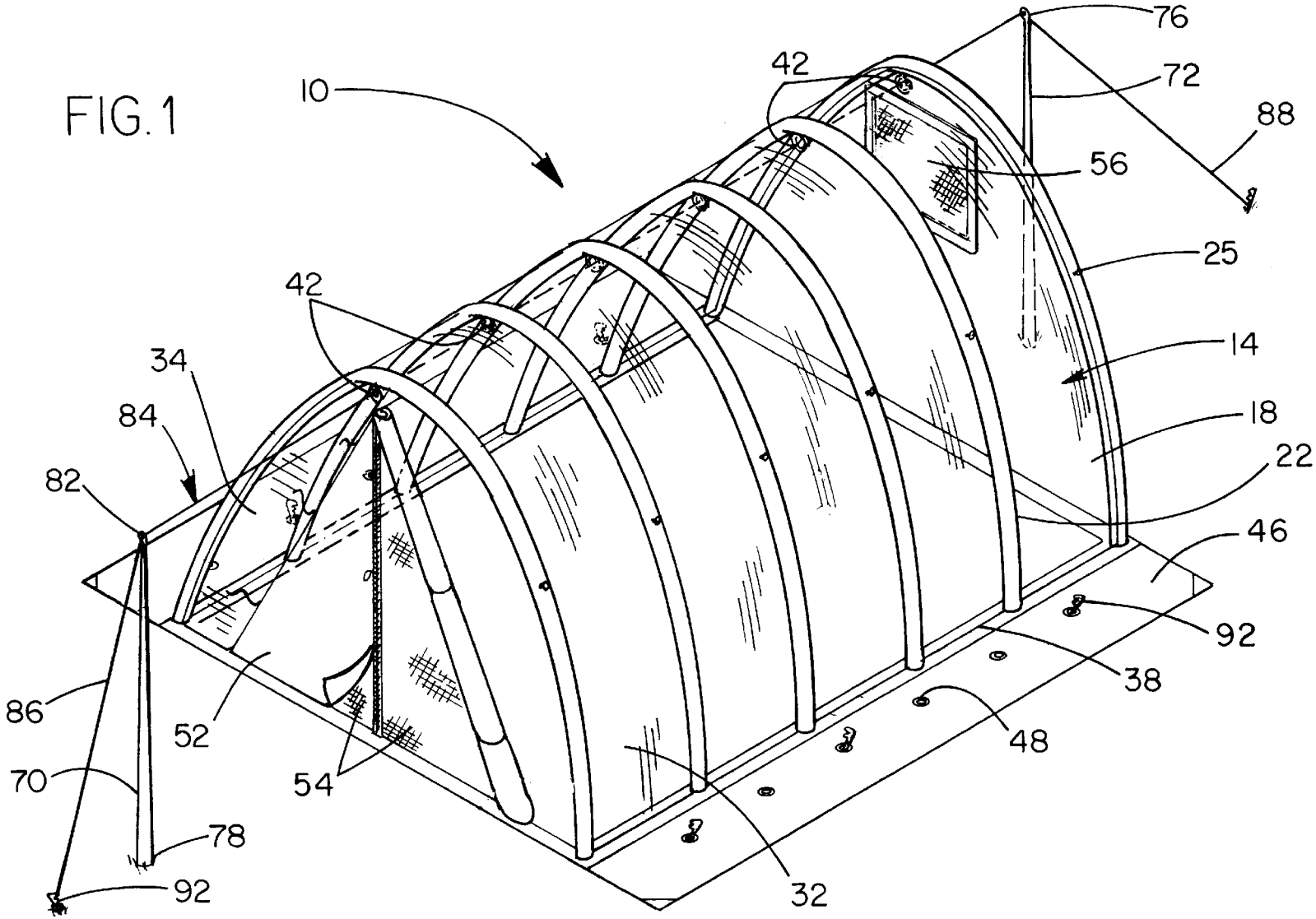
FIG. 1 is a perspective illustration of the preferred embodiment of the home greenhouse kit constructed in accordance with the principles of the present invention.

With reference now to the drawings, and in particular to FIG. 1 thereof, a new and improved home greenhouse kit embodying the principles and concepts of the present invention and generally designated by the reference numeral 10 will be described.

The present invention, the new and improved home greenhouse kit, is comprised of a plurality of components. Such components in their broadest context include an upper portion, a floor portion, support poles and a support rope. Such components are individually configured and correlated with respect to each other so as to attain the desired objective.

Figure 4:
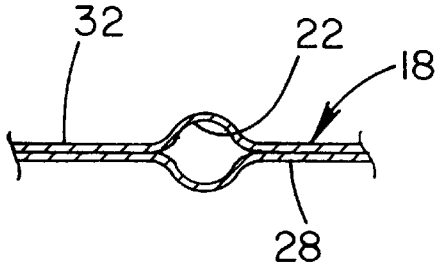
FIG. 4 is a sectional through the rib channel of the present invention.

More specifically, the present invention includes a semi-circular housing member 10. The housing member, as seen in FIG. 1, has an upper portion 14. The upper portion is formed by two layers of flexible sheeting 18 and a plurality of elongated parallel rib channels 22. As illustrated in FIG. 4, the rib channel are formed between the two layers. The plurality of elongated parallel rib channels are proportionately spaced one from another.

Figure 3:
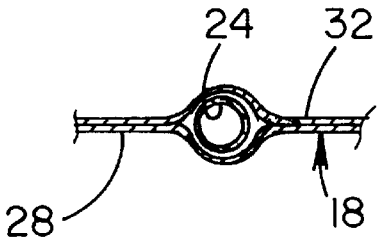
FIG. 3 is a sectional through the inflated tube within the rib channel.

Also, a plurality of inflatable tubes 24 are sized for positioning within the plurality of elongated rib channels. In FIG. 3, the inflatable tube of the present invention is shown in the inflated orientation in the rib channel. Each of the plurality of elongated rib channels has an inflation nozzle 25 that projects exteriorly for use in inflation. It should be understood that the present invention will function with the rib channel not including the inflatable tubes and being the inflatable section. Preferably the plurality of inflatable tubes are used because of the added strength they would give to the structure. The plurality of inflatable tubes give the upper portion of the semi-circular housing member vertical integrity.

Additionally, the upper portion has an interior wall 28, an exterior wall 32, a front wall 34 and a rear wall 36 all connecting at a peripheral end edge 38. The interior wall has a plurality of interior grommets 42. As seen in FIG. 1 the plurality of interior grommets are positioned about an arc of the upper portion. One of each of the plurality of grommets is juxtapose one of the plurality of rib channels 22.

As best illustrated in FIG. 1, a pair of ground panels 46 are provided. The pair of ground panels of the semi-circular housing member is interconnected to the upper portion at the peripheral end edge. This in done by either a heat seam or molding. The pair of ground panels, like the upper portion, are formed by two layers of flexible sheeting. The pair of ground panels 46, as seen in FIG. 1, extend outwardly from symmetrical sides of the exterior wall of the upper portion. Each of the pair of ground panels has a plurality of exterior grommets 48 spaced from an end edge.

Figure 2:
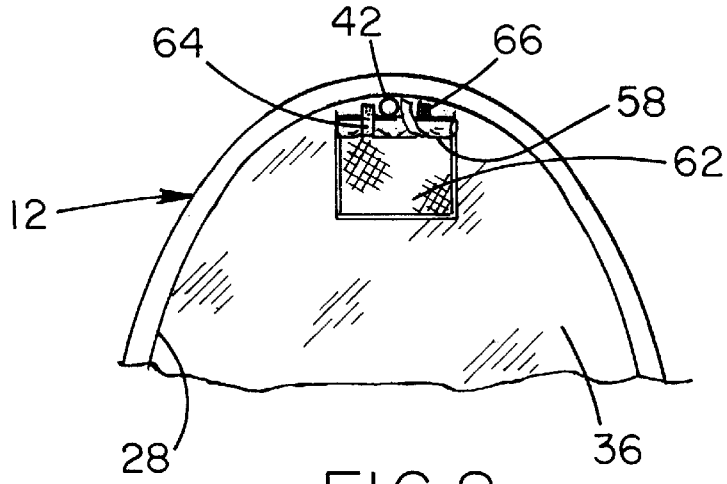
FIG. 2 is a rear view of the upper portion of the present invention.

The front wall of the upper portion of the semi-circular housing member has a door flap 52 and a screen portion 54. The door flap and screen portion allow entry and exit of the semi-circular housing member. The rear wall has a rear window 56. FIG. 2 shows the rear window with a covering flap 58, a screen 62 and straps 64 with pile-type fastener members 66. The cover flap is rolled up and secured by the straps to allow air into the semi-circular housing member.

Figure 5:
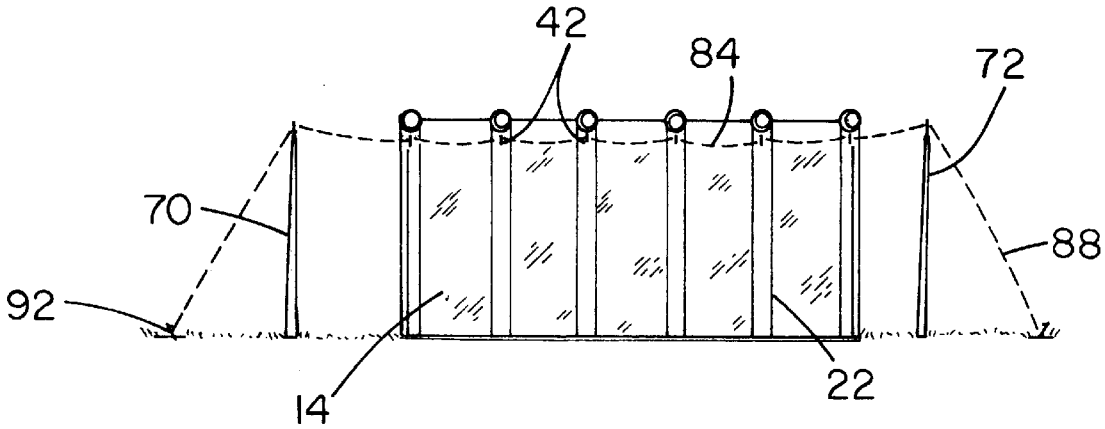
FIG. 5 is a side view of the present invention of FIG. 1.

Included are a pair of support poles. The support poles form a front support pole 70 and a rear support pole 72. Each support pole has a top end 76 and a bottom end 78. The bottom end of each pole has a diameter greater than a diameter of the top end. Each top end has an eyelet 82. As seen in FIG. 5, each pole is position into the ground with the front support pole spaced from the front wall and the rear support pole spaced from the rear wall. As much as possible the poles are in parallel alignment.

Lastly, an elongated support rope 84 is extended through the plurality of interior grommets 42. The support rope, when positioned through the interior grommets, has a front portion 86 extending from the front wall of the upper portion and a rear portion 88 extending from the rear wall of the upper portion. The front portion of the support rope, as seen in FIG. 5, is threaded through the eyelet of the front sup port pole for securement to the ground with an anchor rod 92. The rear portion of the support rope is threaded through the eyelet of the rear support pole for securement to the ground with an anchor rod. The support rope is threaded through the interior grommets and secured to the ground for ensuring that the integrity of the upper portion is maintained from tensions caused by the securement of the support rope.

The present invention is a portable greenhouse that comes in a kit form that includes the semi-circular housing member, the pair of support poles, the support rope and the anchor rods. The plurality of anchor rods are used to secure the ground panels and the support rope.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A new and improved home green house kit comprising, in combination:

a semi-circular housing member having an upper portion, the upper portion being formed by two layers of flexible sheeting and a plurality of elongated parallel rib channels formed between the two layers, the plurality of elongated parallel rib channels being essentially equally spaced one from another, a plurality of inflatable tubes being sized for positioning within the plurality of elongated rib channels for giving the upper portion of the semi-circular housing member vertical integrity, the upper portion having an interior wall, an exterior wall, a front wall and a rear wall, the interior wall having a plurality of interior grommets positioned about an arc of the upper portion and one of each of the plurality of grommets being juxtaposed with respect to one of the plurality of rib channels;

a pair of ground panels of the semi-circular housing member being interconnected to the upper portion, the pair of ground panels being formed by two layers of flexible sheeting, the pair of ground panels extending outwardly from symmetrical sides of the exterior wall of the upper portion, each of the pair of ground panels having a plurality of exterior grommets spaced from an end edge thereof;

the front wall of the upper portion of the semi-circular housing member having a door flap and a screen portion, the door flap and screen portion allowing entry and exit of the semi-circular housing member;

a pair of support poles forming a front support pole and a rear support pole, each support pole having a top end and a bottom end, the bottom end of each pole having a diameter greater than a diameter of the top end, each top end having an eyelet; and an elongated support rope being extended through the plurality of interior grommets, the support rope, when positioned through the interior grommets, having a front portion thereof extending from the front wall of the upper portion and a rear portion thereof extending from the rear wall of the upper portion, the front portion of the support rope being threaded through the eyelet of the front support pole for securement to the ground, the rear portion of the support rope being threaded through the eyelet of the rear support pole for securement to the ground, the support rope being threaded through the interior grommets and secured to the ground for ensuring that the integrity of the upper portion is maintained from tensions caused by the securement of the support rope.

2. A home green house kit comprising:

a semi-circular housing member having an upper portion and a pair of ground panels, the upper portion being formed by two layers of flexible sheeting and a plurality of elongated parallel rib channels formed between the two layers, the pair of ground panels of the semi-circular housing member being interconnected to the upper portion, a plurality of inflatable tubes being sized for positioning within the plurality of elongated rib channels for giving the upper portion of the semi-circular housing member vertical integrity, a plurality of interior grommets positioned about an arc of the upper portion;

a pair of support poles forming a front support pole and a rear support pole, each support pole having a top end with an eyelet; and an elongated support rope being extended through the plurality of interior grommets, the support rope having a front portion extended through the eyelet of the front support pole and a rear portion extended through the eyelet of the rear support pole.

3. The home green house kit as set forth in claim 2, wherein the plurality of elongated parallel rib channels of the upper portion of the semi-circular housing member are essentially equally spaced one from another.

4. The home green house kit as set forth in claim 2, wherein the upper portion includes an interior wall, an exterior wall, a front wall and a rear wall, the interior wall having the plurality of interior grommets positioned thereon and one of each of the plurality of grommets being juxtaposed with respect to one of the plurality of rib channels.

5. The home green house kit as set forth in claim 4, wherein the pair of ground panels extend outwardly from symmetrical sides of the exterior wall of the upper portion, each of the pair of ground panels having a plurality of exterior grommets spaced from an end edge, each of the grommets receiving an anchor rod.

6. The home green house kit as set forth in claim 4, wherein the front wall of the upper portion of the semi-circular housing member being formed with a door flap and a screen portion, the door flap and screen portion allowing entry and exit of the semi-circular housing member.

7. The home green house kit as set forth in claim 2, wherein the support rope is located through the eyelet of the front support pole and the rear support pole for securement to the ground for ensuring that the integrity of the upper portion is maintained from tensions caused by the securement of the support rope.

* * * * *